United States Patent [19]

Scovin

[11] Patent Number: 5,001,475

[45] Date of Patent: Mar. 19, 1991

[54] PORTABLE TRAFFIC CONTROL DEVICE

[76] Inventor: Scott Scovin, 435 Old Stratfield Rd., Fairfield, Conn. 06430

[21] Appl. No.: 496,938

[22] Filed: Mar. 21, 1990

[51] Int. Cl.[5] ..... G08G 1/095

[52] U.S. Cl. ..... 340/908; 40/612; 116/63 P; 340/931

[58] Field of Search ..... 340/908, 931, 471, 473; 116/63 R, 63 P; 40/610, 612, 538, 539, 586; D10/114, 115; D20/17

[56] References Cited

U.S. PATENT DOCUMENTS

| | | | |
|---|---|---|---|
| D. 69,606 | 3/1926 | Mount . | |
| D. 74,859 | 4/1928 | Alexander . | |
| D. 77,883 | 3/1928 | Butler . | |
| D. 86,679 | 4/1932 | MacKenzie . | |
| D. 87,088 | 5/1932 | Strauss . | |
| D. 98,028 | 12/1935 | Felz . | |
| D. 99,034 | 3/1936 | Le Fevre . | |
| D. 220,013 | 2/1971 | Kaltman . | |
| 3,046,521 | 7/1962 | Cantwell et al. | 340/908 |
| 3,702,033 | 11/1972 | Coleman | 340/908 |
| 3,886,519 | 5/1975 | Hovland | 116/63 P |
| 4,401,969 | 8/1983 | Green et al. | 340/931 |
| 4,616,225 | 10/1986 | Woudenberg | 340/908 |
| 4,777,751 | 10/1988 | Pasquale | 340/908 |
| 4,835,534 | 5/1989 | Lucas | 340/931 |

FOREIGN PATENT DOCUMENTS

| | | | |
|---|---|---|---|
| 2506718 | 8/1976 | Fed. Rep. of Germany | 340/908 |

*Primary Examiner*—Joseph A. Orsino
*Assistant Examiner*—Brent A. Swarthout
*Attorney, Agent, or Firm*—H. Gibner Lehmann; K. Gibner Lehmann

[57] ABSTRACT

A portable ground-supported automobile traffic control device including an upright, double-sided human-shaped figure which is so constructed and configured as to simulate a traffic control officer, and having one arm and hand in a raised position and carrying thereon, back-to-back electrical stop-and-go traffic light signal units. The traffic light signal units face in opposite directions, and are powered by storage batteries in a base that is provided for the figure. An automatic controller is connected to the signal units and to the batteries, to effect synchronized stop, stop-and-go, or other displays on the traffic light signal units, thereby to provide visual directions to motorists for the orderly control of two-way traffic in the vicinity of the figure.

15 Claims, 3 Drawing Sheets

10
11
12
14
16
18
20
22
24
26
28
30
32
34
36
38
40
42
44
46
48
52
54
58
60
62
64
66
68
70
72
74
76
80
82
84
88
90

PORTABLE TRAFFIC CONTROL DEVICE

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to traffic control devices, and more particularly to automatic, non-attended devices for use to replace personnel at temporary locations.

2. Description of the Related Art Including Information Disclosed Under 37 §§CFR 1.97-1.99

Various types of traffic control devices are illustrated in U.S. Design Pat. Nos. D 69,606; D 74,859; D 77,883; D 86,679; D 87,088; D 98,028; D 99,034; and D 220,013. All of these patents illustrate various forms involving figures of a man/robot holding either traffic control signs or lighting arrangements for conveying information to a vehicle operator as to particular conditions which exist on a roadway. The specific function of each arrangement is not, however, discussed in view of the fact that the patents are all design patents, which relate solely to the ornamental appearance of a particular object.

Furthermore, it is believed that the devices cited in the previous paragraph have not achieved acceptance in the field, since to the knowledge of the applicant, none is currently being used, even in the many congested regions of the country that are known to exist today.

In the past, maintenance and repairs required at work sites along roads and highways has at best, caused mere inconvenience to the average driver, and in some cases posed a safety hazard to both the workmen and the drivers themselves. For example, during the laying of sewer lines, repair of electrical or gas lines, or repair of the road bed itself, it has been customary for the particular party performing the work to retain the services of a police officer in order to direct traffic around the site, in a safe and orderly manner. Several problems arise in such situations.

In particular, the officer must be paid, typically at a rate of time-and-a-half or double-time, depending upon the scheduling of the work. Where municipalities perform the work, the money is usually budgeted in advance. On the other hand, where such work is being done by a telephone company or other utility, the costs are in most cases absorbed by the particular utility.

Frequently after an hour or so on the job site, the officer inevitably becomes either tired or bored, and often temporarily abandons his stand to chat with the workers, at least for short periods of time and if traffic tends to lighten up. Oncoming drivers are then faced with decisions as to when it is safe to pass, which is obviously undesirable from the safety standpoint. Also, there have been many occasions in the past where the arm movements of an officer are not immediately understood by a driver. On the contrary, such arm movements may only serve to confuse the driver, leaving him with the thought, "Is the officer indicating 'stop' or 'go'?"

Finally, there exists a problem where a single officer is assigned to a construction area that extends for more than 100 feet or so, since he must position himself somewhere in the middle of the site, make himself visible to the drivers entering both ends of the site, and direct traffic accordingly. In many cases, two officers are stationed at the opposite ends of a site, with each one coordinating his instructions with the other so that the traffic flow can be controlled in an orderly fashion, with alternating pause and pass intervals.

SUMMARY OF THE INVENTION

The above disadvantages and drawbacks of prior traffic control arrangements are largely obviated by the present invention, which has for one object the provision of a novel and improved signalling system which is extremely simple in its construction, while at the same time being reliable in use over extended periods of time.

A related object of the invention is to provide an improved signalling system as above set forth, wherein the system is physically small and portable, and can be readily transported as in a utility or service van, from a storage facility to a work site, and thereafter quickly and conveniently assembled by the workmen at the site without the need for special tools, and without requiring any special knowledge or skill on the part of such workmen.

Still another object of the invention is to provide an improved signalling system as above characterized, which is completely self-contained and which during operation, does not require electrical connection either to a vehicle or to commercial power mains, making the system especially well suited for locations where power is unavailable or not readily accessible. The voltages involved are low, typically 12 volts d. c. and thus there is no shock hazard to personnel at the site.

Yet another object of the invention is to provide an improved signalling system as outlined above, which can be used either by itself, or in conjunction with a traffic control officer in which latter case the officer's efforts and attention requirements are significantly reduced, thus enabling him to oversee other potential problems at the site not directly related to traffic movements.

A still further object of the invention is to provide an improved signalling system as above characterized, wherein the flow of traffic at remotely spaced opposite ends of the work site can be controlled, by use of a master unit at one entrance/exit of the site, with one or more slave units at the second entrance/exit of the site, and wherein the slave unit or units can be readily connected to the master unit without any modification of the master unit whatsoever.

Yet another object of the invention is to provide an improved signalling system of the kind indicated, wherein a failsafe feature incorporated in the master unit effectively prevents the simultaneous display of a green, "go" light at two locations of a work site which are not consistent with such an instruction, as for example at the opposite ends of a work site having a single lane by-pass, thus virtually eliminating a potential hazard involving vehicles inadvertently approaching one another head on.

Another object of the invention is to provide an improved signalling system as above set forth, wherein conventional patterns of traffic light control are available, namely the switched "green-orange-red" sequence with or without adjustable timing, or simple "blinking" orange or red operation, as desired.

In accomplishing the above objects the invention provides a portable ground-supported automobile traffic control device comprising an upright, double-sided human-shaped figure which is so constructed and configured as to simulate a traffic control officer, the figure having one arm and hand in a raised position for signalling traffic, back-to-back electrical stop-and-go traffic light signal units supported by the raised arm of the upright figure and located on both of the opposite sides thereof, and energy supply means for the signal units. The invention further provides for automatic control means connected to the signal units and to the energy-supply means, for automatically energizing the signal units to effect alternate stop-and-go modes thereof at the opposite sides of the upright double-sided figure, thereby to provide visual directions to motorists for the orderly control of two-way traffic in the vicinity of the figure.

The device of the invention is sufficiently light in weight and portable, to enable it to be transported to a work site in a utility vehicle, and readily set up at the site by one or more workers, without special equipment and with no special skills required on the part of the worker/workers. Following use, the device can be disassembled and returned to the utility vehicle for storage, and subsequent use either at the same site on the following day, or at another site.

Since the device is completely self-contained, no electrical connections need be made to the utility vehicle itself, or to commercial power mains. In the latter instance, potential problems with shock hazard to the workers, obtaining permission from the electrical utility, and the like, are thus completely eliminated.

The device can be used by itself, as the sole control means for traffic flow around the work site, or alternately as an adjunct to a traffic control officer, whose presence might be required by law. In such cases, the device need not be attended to by the officer, thereby freeing him for making observations relating to overall traffic flow, possible accidents and other matters that might periodically warrant his attention.

Other features and advantages will hereinafter appear.

BRIEF DESCRIPTION OF THE DRAWINGS

In the drawings, illustrating preferred embodiments of the invention.

DESCRIPTION OF THE PREFERRED EMBODIMENTS

Figures 1, 2:
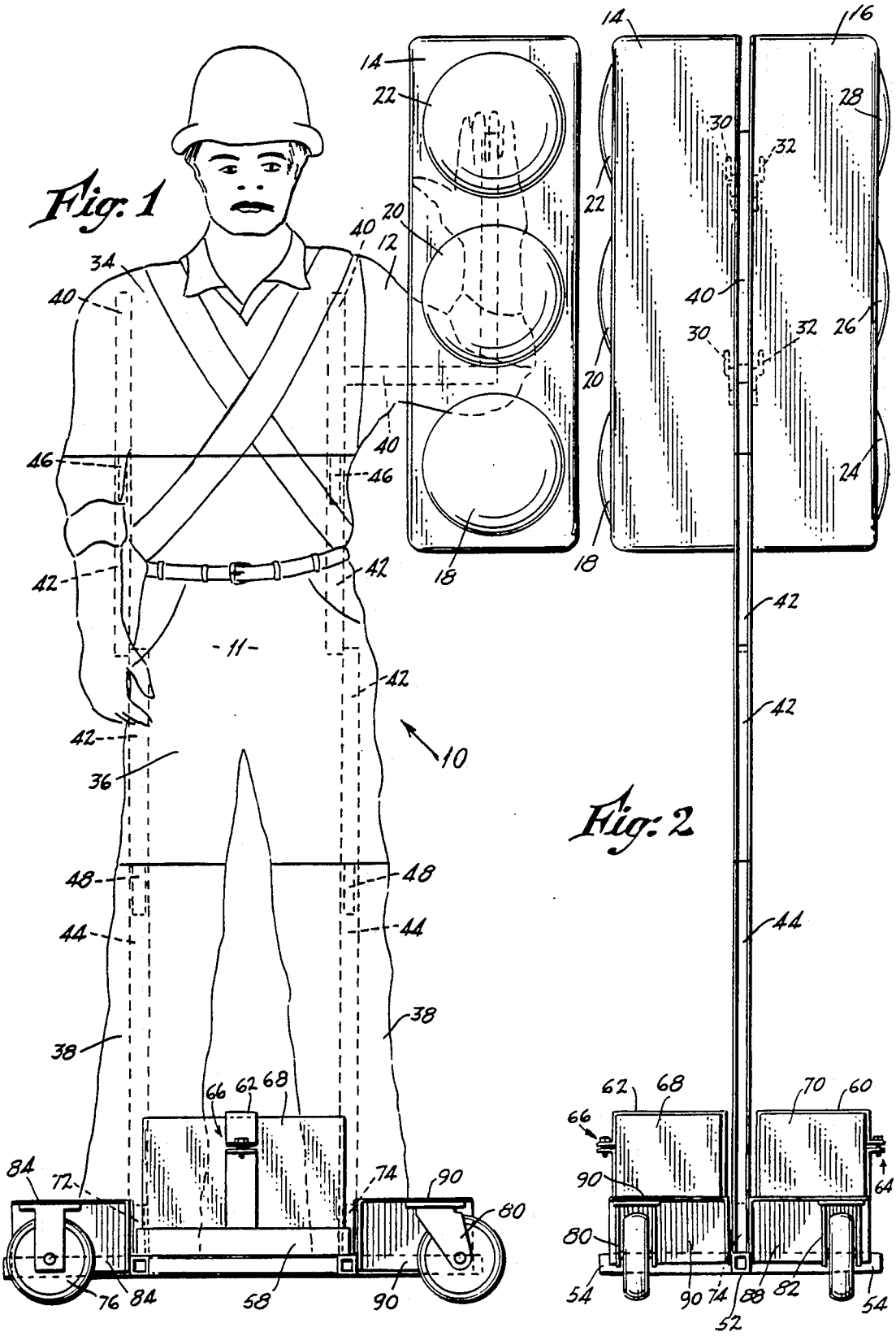
FIG. 1 is a front elevational view of the traffic control signalling of the present invention, illustrating the outline of a man, having one arm raised and supporting back-to-back arrays of traffic lights.
FIG. 2 is a side elevation of the traffic control signalling system of FIG. 1.

Referring first to FIGS. 1 and 2, and in accordance with the present invention there is provided a ground-supported automotive vehicle traffic control device generally designated by the numeral 10, comprising an upright, double-sided human-shaped FIG. 11 having the configuration of a traffic control officer. The figure has one arm and hand 12 disposed in a raised position, and there are removably mounted on the raised arm/-hand 12 a pair of back-to-back traffic light signal units 14, 16 respectively, each unit constituting an array of lights similar to that of a conventional traffic light. The green, orange, and red lights of the arrays 14, 16 respectively are indicated by the numerals 18, 20, 22, and 24, 26, 28, respectively. Upwardly facing hook pairs 30, 32 on the figure are received in cooperable slot pairs in the rear surfaces of the metal housings for the arrays 14, 16, FIG. 2, for releasably carrying the arrays on the arm and hand 12.

By the invention, the FIG. 11 is constituted of multiple sections 34, 36 and 38, respectively, shown in the drawings as three in number, which sections are separable from one another and capable of being assembled at the work site where the traffic control device 10 is to be used. The upper section 34 is shown as including the head, chest, the upper portion of one arm, and the raised arm and hand 12 of the figure. The panels making up the figure are constructed from sheet metal, preferably provided with a zinc-chromate coating for corrosion resistance, and suitably painted in a multi-color pattern to present the appearance of a traffic control officer. The middle section 36 of the figure comprises the waist and thighs of the figure, and the lower sections 38, the knees and ankles.

By the invention, each section 34, 36 and 38 has superposed back-to-back panels of the same outline, whereby one constitutes a mirror image of the other the panels being welded to tubular supports 40, 42 and 44, indicated in dotted outline in FIG. 1. The supports 40, 42 and 44 are preferably constituted of square-section tubular stock, and the lower ends of the supports 40 of the uppermost section 34 are provided with portions 46 of reduced dimension, enabling them to be telescopically received in corresponding aligned square-section supports 42 of the middle section 36. These are also shown in dotted outline in FIG. 1.

In a similar manner, the middle section 36 of the FIG. 11 is constituted of back-to-back panels welded to the supports 42, and the reduced-dimension lower end portions 48 of the supports are telescopically received in the tubular supports 44 of the lower sections 38. The adjacent edges of sections 34 and 36, and sections 36 and 38 abut one another, as shown in FIG. 1, to form the composite FIG. 11.

Figure 3:
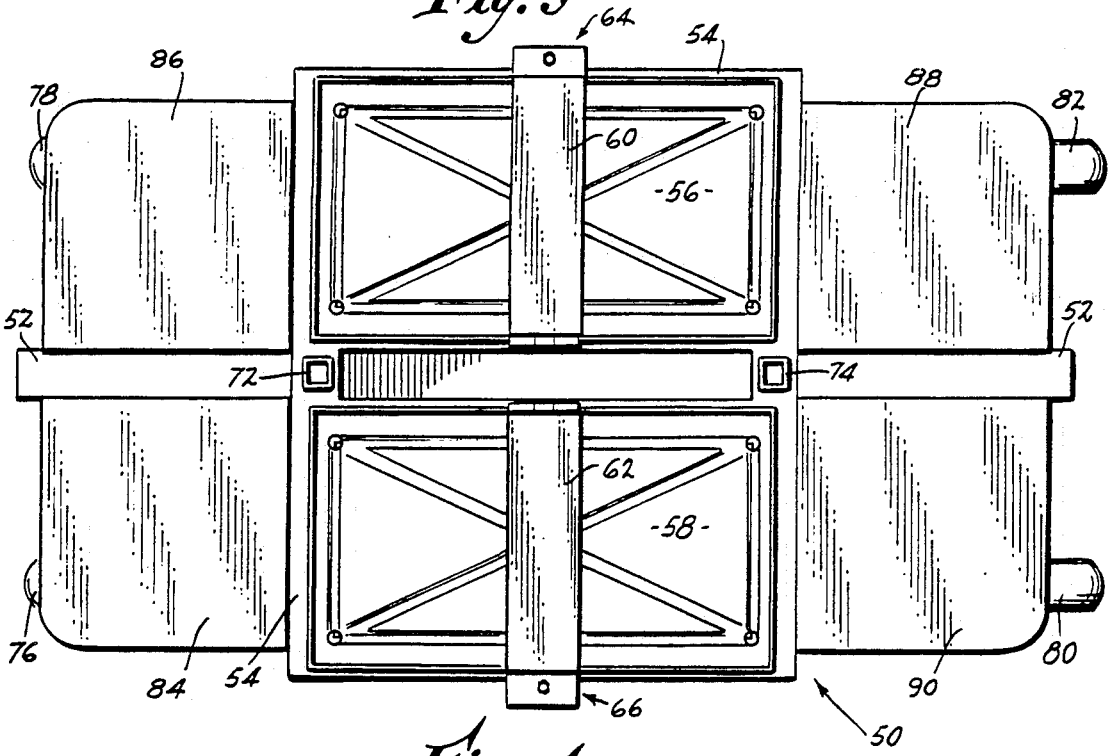
FIG. 3 is a top plan view of the base of the system of FIGS. 1 and 2.
Figure 4:
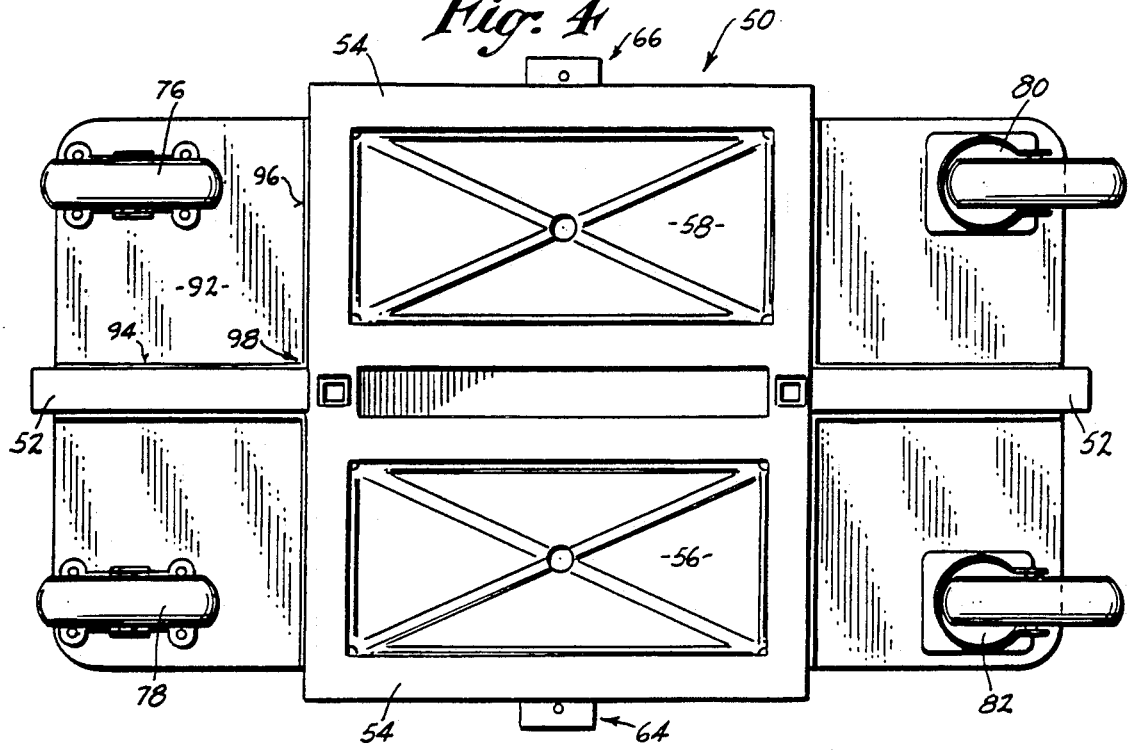
FIG. 4 is a bottom plan view of the base of the system of FIG. 3.

Referring now to FIGS. 3 and 4 and in accordance with the present invention, the device 10 further comprises a carriage 50 including a chassis 52 constructed of tubular stock preferably of square-section, similar to that of the supports 40, 42 and 44 employed with the sections 34, 36 and 38 of the FIG. 11. The chassis 52 has a central portion 54 of generally rectangular outline, with a pair of trays 56, 58 welded thereto in side-by-side relation. The trays have hinged straps 60, 62 respectively with pairs 64, 66 of fastening tabs, each of the trays 56, 58 being adapted to respectively hold one storage battery 68, 70 which can be of conventional design and of a type similar to that used in automotive vehicles. Preferably the rating of the batteries is sufficient to permit continuous operation of the two arrays 14, 16 of traffic lights for a full 48 hour period. If additional operating time is required, auxiliary batteries (not shown) can be provided. If necessary, the batteries can be re-charged as required, or alternately, substitute batteries installed in the system 10, to enable continuous use thereof as might be required over a long weekend, etc.

Referring again to FIGS. 1 and 3, by the invention the chassis 52 has two upstanding projections 72, 74 of square section which are telescopically received in the lowermost ends of the supports 44 of the lower sections 38 of the FIG. 11, as shown in FIG. 1. Two wheels 76, 78 and two casters 80, 82 are provided, to facilitate positioning the FIG. 11. The wheels and casters are carried respectively in four wheel housings 84, 86, 88 and 90 on the chassis 52, each of which has three faces corresponding to three intersecting faces of a cube; for example, the intersecting faces of the housing 84 are designated 92, 94 and 96, meeting at a common dihedral corner 98. The four wheel housings 84, 86, 88 and 90 are welded to the central, rectangular portion 54 of the chassis 52. As shown in FIG. 1, the chassis 52 lies in a plane which contains the lower edges of the wheel housings 84, 86, 88 and 90.

Electrical leads (not shown in FIGS. 1 or 2) extending between the arrays 14 and 16 and the batteries 68, 70, can be tucked in the space between the panels of each of the sections 34, 36 and 38, for aesthetic purposes, and to minimize the possibility of their becoming snagged on clothing or other objects.

Figure 6:
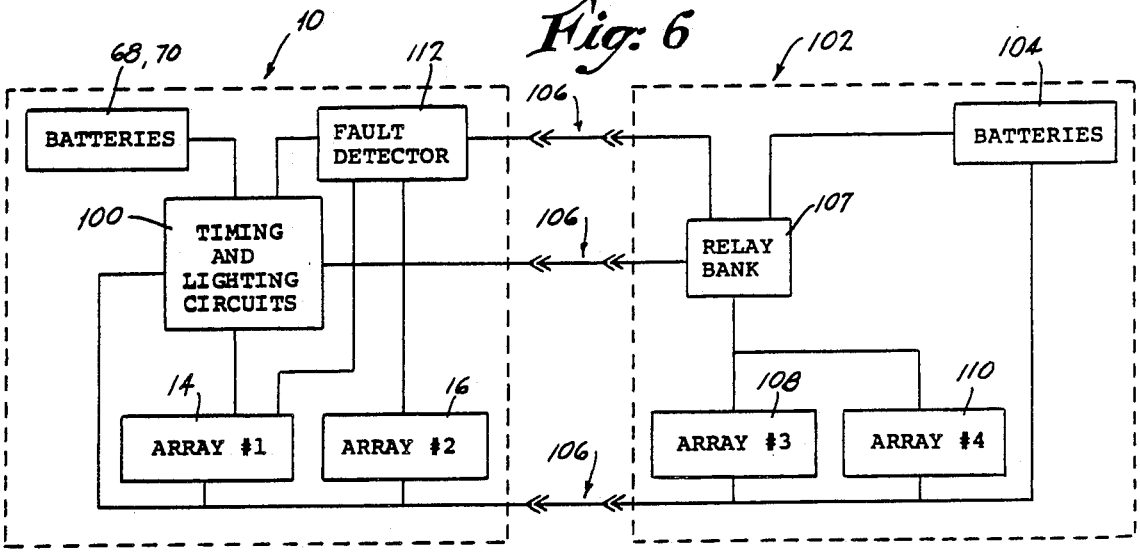
FIG. 6 is a block diagram of the signalling system of FIG. 5, illustrating various components thereof.

Contained in the housing for one of the arrays 14 or 16 is a timing and lighting circuit 100, FIG. 6, powered by the batteries 68, 70 and having electrical leads extending to the green, orange and red lamps of each array 14, 16. The particulars of the timing circuitry are well known in the traffic signal field and are thus not presented in the present application since they form no part of the invention per se.

In use, the FIG. 11 is transported to the site and assembled, with the batteries 68, 70 placed in the respective trays 56, 58, and electrical leads connected between the batteries 68, 70, the timing and lighting circuit 100, and the arrays 14, 16. The housings for the arrays 14, 16 contain switches (not shown) that are used for controlling the various functions desired, as for example selecting between conventional switched light sequences, blinking red/orange operation, etc.

In the case that the traffic control device 10 is arranged to function with the conventional switching sequence, the light array 14 will operate in opposition to the light array 16, in a manner exactly the same as that of a four way traffic light, wherein the arrays 14, 16 correspond to two adjacent arrays of the four way device. In the case of a work site having a single lane roadway as a by-pass, the device is preferably located as close to the lane as possible, while still being out of the direct path of vehicular traffic, such that the arrays 14, 16 are plainly visible to on-coming traffic from either direction. With such an arrangement, there is no need for a traffic officer to be present exactly at the location of the device, since control of the vehicle flow is completely assumed by the device. It may be desirable to adjust the switching interval in order to accommodate particular conditions or traffic patterns that are peculiar to a specific location, as can be readily understood.

Figure 5:
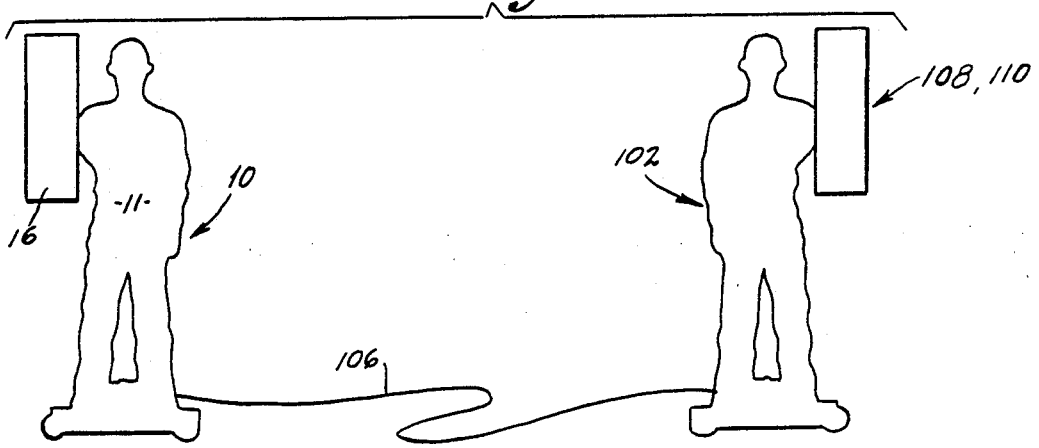
FIG. 5 is a diagrammatic representation of the signalling system of FIGS. 1 and 2, and including additions to the system, illustrating a primary or master unit substantially identical to that of FIGS. 1 and 2, and in addition, a slave unit of somewhat similar construction, connected to the primary or master signalling unit and adapted for use therewith. The master signalling unit is intended to be positioned at one entrance/exit location of a work site, with the slave unit being located at the second entrance/exit location of the work site, under the circumstance where such locations are spaced apart by typically a hundred feet or more, and where visibility of a single primary signalling unit might not be, sufficient, or adequate to alert multiple drivers approach work site from either direction.

Another embodiment of the invention is illustrated in FIG. 5, which shows the traffic control system 10 depicted in FIGS. 1 and 2, supplemented by a slave unit 102 which is of construction similar to that of the system 10 of FIGS. 1 and 2. In FIG. 6, the portion of the circuit illustrated in dotted outline and designated 10 represents the system of FIGS. 1 and 2. In particular, there are provided the light arrays 14, 16, the controller 100 indicated as "timing and lighting circuits", which is preferably of a construction that is conventional with existing traffic lights and as such forms no part of the present invention, and storage batteries indicated 68 and 70 which are connected in parallel. The timing and lighting circuits 100 are arranged to provide the desired lighting sequence for the arrays 14, 16. For example, as noted above, when the control system 10 is employed by itself, without the slave unit 102, the green-orange-red sequence of the array 14 would be in opposition to that of the array 16. In this manner, vehicles presented with a green light at the front of the FIG. 11 would proceed, since the corresponding light at the rear of the FIG. 11 would be red, and vice-versa. Adjustable timing, and provision of blinking red, and/or blinking orange lights, could be readily incorporated in the present arrangement, since these functions are considered to be conventional in the traffic light field.

FIGS. 5 and 6 illustrate the slave unit 102 as having a physical configuration substantially identical to that of the primary or master control device or system 10. The slave unit 102 would be employed where the work site is expansive to the extent that the distances involved between one entrance/exit location and the other was such that it was not possible to locate a single control system 10 such as the one illustrated in FIGS. 1 and 2 at a single, central position of prominence, visible from both locations.

The slave unit 102 incorporates its own batteries 104, as in the case of the master or primary system 10. A multi-conductor interconnecting cable 106 is provided to coordinate the signals controlling the master system 10 and slave unit 102, so that they operate in proper synchronism with one another. The slave unit 102 preferably has a bank of relays 107 which are driven from the timing and lighting circuits 100 of the master system 10. The relays are powered by the batteries 104, and their operation is governed by signals received from the master system 10. The light arrays of the slave unit 102 are designated 108 and 110 respectively.

In a preferred embodiment, the lighting sequence of array 108 would duplicate that of array 14, whereas the lighting sequence of array 110 would duplicate that of array 16; of course it is necessary to insure that the slave unit 102 is facing in the proper one of two possible directions, as can be readily understood.

By such an arrangement, vehicles presented with a green light at array 14 would also be presented with a green light at array 108, and traffic facing in the opposite direction would be presented with red lights on arrays 16 and 110 respectively.

Figure 7:
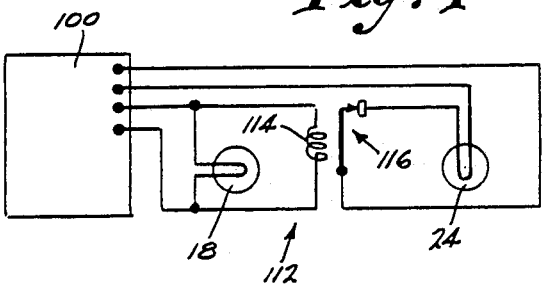
FIG. 7 is a schematic diagram of the fault detector of FIG. 6.

Referring to FIGS. 6 and 7 and in accordance with the invention, a fault detector 112 is included in the traffic control signalling system, as a circuit separate and apart from the timing and lighting circuit 100. The fault detector prevents the simultaneous display of green lights on the arrays 14 and 16. Such a condition might result from inadvertent circuit failure in the timing and lighting circuit 100, and would constitute a hazard, since oncoming traffic from both directions would approach one another in the single lane, causing confusion and possibly leading to an accident.

Specifically, in FIGS. 2 and 7, the green light of array 14 is indicated 18, whereas the green light of array 16 is indicated 24. In FIG. 7, the fault detector 112 can take the form of a simple relay whose coil 114 is energized when the green light 18 of array 14 is energized, and which has contacts 116 in series with the green light 24 of array 16, which contacts 116 are normally closed when the coil 114 is de-energized, but which open when the coil 114 becomes energized. With the addition of the slave unit 102, the fault detector 112 would still be operative in the event of a circuit failure in the timing and lighting circuit portion 100 of the system 10, to prevent the simultaneous display of green lights on arrays indicated 108 and 110, FIG. 6, for instance.

Preferably the arrays 14, 16, 108 and 110 of traffic signal lights are of a physical configuration similar to that of conventional traffic lights, whereby they constitute familiar figures to vehicle operators, and are highly visible. The FIG. 11 can be preferably between 6 and 8 feet high, and suitably painted, will resemble an actual person as viewed from a distance by oncoming vehicles.

As noted above, the control system 10 could conceivably eliminate the need for an on-site traffic officer, where local regulations permit. However, in the case where the presence of an officer is required by law, the use of the system as an accessory or adjunct would greatly simplify his duties and eliminate the problems noted above in connection with the distraction, boredom and/or fatigue. In addition, since the officer need not direct traffic personally, the possibility of his being inadvertently struck by a vehicle is minimized. This is frequently a problem under conditions of fog, precipitation, darkness, dust or other factors adversely affecting visibility. Operator carelessness is also a factor in such accidents.

From the above it can be seen that I have provided novel and improved traffic control signalling systems which are simple in their structure, light weight, and portable so that they can be easily transported from a storage garage, via a utility vehicle, directly to the desired work site and thereafter readily assembled by a single worker and without the use of special tools or specialized know-how. The batteries, being relatively heavy as compared to the remainder of the system, are located in the base to provide good stability and to resist any tendency for the FIG. 11 to be upset by wind, passing vehicles, etc.

The disclosed devices are thus seen to constitute a distinct advance and improvement in the field of traffic control systems.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A portable ground-supported automobile traffic control device comprising, in combination:

(a) an upright, double-sided human-shaped figure which is so constructed and configured as to simulate two oppositely-facing substantially mirror-image-outlined back-to-back traffic control officers, said figure having support means extending from a side portion of the figure, (b) back-to-back electrical stop-and-go traffic light signal units supported by said support means of the upright figure and facing generally in directions extending from opposite sides of the figure, (c) energy supply means for said signal units, and (d) automatic control means connected to said signal units and to said energy-supply means, automatically energizing the back-to back electrical stop-and-go traffic light signal units to effect automatic alternate stop-and-go modes thereof at the opposite sides of said upright double-sided figure, thereby to provide visual directions to motorists for the orderly control of oncoming two-way traffic approaching the two oppositely facing simulated traffic control officers in the vicinity of the figure.

2. A traffic control device as set forth in claim 1, wherein:

(a) said device comprises a four-wheeled carriage, and (b) cooperable telescoping means on said carriage and figure, for separably mounting the latter on the carriage.

3. A traffic control device as set forth in claim 2, wherein:

(a) said carriage has two castors and two fixed-axis wheels.

4. A traffic control device as set forth in claim 3, wherein:

(a) said carriage comprises a tubular-frame chassis having a rectangular central portion, and (b) a tray carried by said central portion, for holding said energy supply means.

5. A traffic control device as set forth in claim 4, wherein:

(a) said chassis comprises four cubic wheel housings in which said wheels and castors are supported, (b) said wheel housings being attached to the four corners of the central portion of the chassis.

6. A traffic control device as set forth in claim 5, wherein:

(a) said chassis lies in a plane which contains the lower edges of said cubic wheel housings.

7. A traffic control device as set forth in claim 6, wherein:

(a) said cubic wheel housings each have a top horizontal side wall and two vertical side walls, (b) all said side walls of each housing meeting and forming a common trihedral corner.

8. A traffic control device as set forth in claim 7, wherein:

(a) said chassis has tubular members extending outward from its rectangular central portion, (b) said cubic wheel housings being paired, and each pair of housings being disposed on opposite sides of, and being attached to one such tubular member of the chassis.

9. A traffic control device as set forth in claim 4, wherein:

(a) an additional tray is disposed alongside of said first-mentioned tray, (b) said additional tray being carried by said central portion of the chassis and containing an electrical energy supply means.

10. A traffic control device as set forth in claim 2, wherein:

(a) said cooperable telescoping means comprises upstanding posts on the carriage, and sockets carried by said figure, for receiving the said posts.

11. A portable groundsupported automobile traffic control device comprising, in combination:

(a) an upright, double-sided human-shaped figure which is so constructed and configured as to simulate a traffic control officer, said figure having one arm and hand in raised position signalling that traffic is to be alerted, (b) back-to-back electrical stop-and-go traffic light signal units supported by the raised arm of said upright figure and located on both of the opposite sides thereof, (c) energy supply means for said signal units, and (d) automatic control means connected to said signal units and to said energy-supply means, automatically energizing the signal units to effect alternate stop-and-go modes thereof at the opposite sides of said upright double-sided figure, thereby to provide visual directions to motorists for the orderly control of two-way traffic in the vicinity of the figure, (e) said figure comprising a pair of similarly configured spaced-apart plates and spacer means interposed between and secured to said plates to maintain the same in the closely-spaced parallel relation.

12. A traffic control device as set forth in claim 11, wherein:

(a) said figure has three separate parts disposed in vertical contiguous order, and (b) cooperable telescoping means on adjacent portions of said parts, for separably connecting the parts in said vertical contiguous order.

13. A traffic control device as set forth in claim 11, wherein:

(a) said plates have surface decorations depicting a traffic officer.

14. A traffic control device as set forth in claim 11, wherein:

(a) said figure has two separate parts disposed one atop the other, and (b) cooperable telescoping means on said parts, for separably connecting the parts to each other.

15. A traffic control device as set forth in claim 12, wherein:

(a) one of said parts of the figure has the head, chest and raised arm and hand of the figure.

* * * * *